US005743234A

United States Patent [19]

Nemoto et al.

[11] Patent Number: 5,743,234

[45] Date of Patent: Apr. 28, 1998

[54] FUEL INJECTOR FOR INTERNAL COMBUSTION ENGINES

[75] Inventors: Hideki Nemoto; Tomoaki Kakihara; Tadashi Uchiyama, all of Fujisawa, Japan

[73] Assignee: Isuzu Motors Limited, Tokyo, Japan

[21] Appl. No.: 794,382

[22] Filed: Feb. 4, 1997

[30] Foreign Application Priority Data

Feb. 9, 1996 [JP] Japan ..... 8-046830

[51] Int. Cl.[6] ..... F02M 41/00

[52] U.S. Cl. ..... 123/446

[58] Field of Search ..... 123/446, 447, 123/467; 417/398, 399, 401

[56] References Cited

U.S. PATENT DOCUMENTS

| | | | |
|---|---|---|---|
| 3,961,612 | 6/1976 | Okamoto et al. | 123/446 |
| 4,437,443 | 3/1984 | Hofbauer | 123/446 |
| 4,844,035 | 7/1989 | Takagi | 123/446 |
| 5,181,494 | 1/1993 | Ausman | 123/446 |
| 5,392,749 | 2/1995 | Stockner et al. | 123/446 |
| 5,622,152 | 4/1997 | Ishida | 123/446 |

FOREIGN PATENT DOCUMENTS

| | | |
|---|---|---|
| 60-243345 | 3/1985 | Japan . |
| 64-15460 | 1/1989 | Japan . |
| 6-294362 | 10/1994 | Japan . |

*Primary Examiner*—Thomas N. Moulis
*Attorney, Agent, or Firm*—Browdy and Neimark

[57] ABSTRACT

In this fuel injector for internal combustion engines, a pressure chamber is provided at an end portion of a pressure increasing piston which is adapted to increase the pressure of a fuel in a pressure increasing chamber, and a hollow portion which is on the back side of the pressure increasing piston is opened to the atmospheric air through communication ports formed in an injector body. The pressure increasing piston comprises a small-diameter portion of a plunger which defines a part of the pressure increasing chamber, a large-diameter portion of a piston which defines a part of the pressure chamber, and a guide ring portion extending downward from the whole circumference of the large-diameter portion and forming a sliding surface with respect to a hollow. The hollow portion is provided with a return spring for biasing the pressure increasing piston toward the pressure chamber. Since the hollow portion of this fuel injector is opened to the atmospheric air, the resistance to the vertical movement of the fuel pressure increasing piston is eliminated, and the responsiveness of the needle valve is improved.

7 Claims, 3 Drawing Sheets

FUEL INJECTOR FOR INTERNAL COMBUSTION ENGINES

BACKGROUND OF THE INVENTION

1. Field of the Invention

This invention relates to a fuel injector having a fuel pressure increasing chamber for internal combustion engines.

2. Description of the Prior Art

Conventional fuel injectors For multicylinder engines include an injector of fuel injection system (electronically controlled fuel injection system) adapted to control the injection quantity and injection timing by an electronic circuit, an injector of common injection system (common rail injection system) adapted to distribute a fuel from an injection pump to each combustion chamber through a common passage, and an injector of pressure accumulation type injection system (accumulator injection system) adapted to distribute a fuel from an injection pump to each combustion chamber through a common passage and an accumulator. In the fuel injectors of these systems, an accumulator in which the fuel from an injection pump is temporally stored is not provided, and the supply of a fuel to each fuel injector is therefore done through a common rail constituting a common passage.

A conventional electrically controlled hydraulically operated type fuel injector for engines include, for example, is disclosed in Japanese Patent Laid-Open No. 294362/1994. This fuel injector is such that the fuel noise and fuel emission in the engine are reduced by variably controlling the fuel flow rate characteristics of a hydraulically operated injector in a fuel injection stroke of the engine.

As shown in FIG. 3, this fuel injector comprises an injector body having a hollow and injection ports 13, and a case 6 which is so provided as to have a clearance no the outside of the injector body and as to form a fuel chamber 20, and which is sealed at one end of the fuel chamber 20 with an engagement surface and at the other end thereof with a contact surface 14. The injector body comprises a nozzle body 2 having injection ports 13, a fuel supply body 5 provided with a fuel pressure increasing chamber 7, an injector body 4 provided with a pressure chamber 8 to which a working oil is supplied, and a solenoid body 3 adapted to operate a solenoid valve 16. The case 6 is engaged at one end thereof with the nozzle body 2 via the contact surface 14 thereof, and fitted fixedly at the other end portion thereof to the injector body 4, in such a manner that the case 6 surrounds the fuel supply body 5 which is between the nozzle body 2 and injector body 4, so as to form the fuel chamber 20, and thereby the fuel chamber 20 is sealed with respect to the outside.

This fuel injector for internal combustion engines has the pressure increasing chamber 7 formed in the fuel supply body 5 and adapted to increase the pressure of the fuel supplied from the fuel chamber 20, the fuel supply body 5 adapted to supply a fuel from the pressure increasing chamber 7 to the injection ports 13, fuel passages 22 formed in a spacer body 21 and nozzle body 2, a needle valve 23 held slidably in a hollow of the nozzle body 2 and adapted to open the injection ports 13 by a fuel pressure, a pressure increasing piston 9 adapted to increase the pressure of the fuel in the pressure increasing chamber 7, a pressure chamber 8 to which a high-pressure working fluid for exerting a high pressure on an end portion of the pressure increasing piston 9 is supplied, and a solenoid valve 16 constituting a control valve for controlling the supply of the high-pressure working oil to the pressure chamber 8. The pressure increasing piston 9 comprises a small-diameter portion 24 constituting a plunger defining at its lower end surface a part of the pressure increasing chamber 7, and a large-diameter portion 25 constituting a piston defining at its upper end surface a part of the pressure chamber 8 and adapted to move reciprocatingly in a cylinder chamber in the pressure chamber 8.

A return spring 18 for exerting a resilient force to the needle valve 23 in the direction in which the injection ports 13 are closed is provided in a hollow 29 formed in the spacer body 21. A return spring 17 for biasing the pressure increasing piston 9 toward the pressure chamber 8 is provided in a hollow portion 3O comprising a hollow 26 of the injector body 4 between an end surface of the large-diameter portion 25 of the pressure increasing piston 9 and an end surface of the fuel supply body 5. The injector body 4 is provided on the working oil cutting side thereof with a return spring 19 adapted to bias the solenoid valve 16. In the fuel injector for an internal combustion engine, the hollow portion 30 in which the pressure increasing piston 9 is provided communicates with the fuel chamber 20 through a passage 28, and the fuel pressure therein is equal to that in the fuel chamber 20.

There is a known fuel supply system for a fuel injector of an internal combustion engine which is shown in FIG. 2. In this internal combustion engine, fuel injectors 1 are provided in cylinders thereof. The fuel injectors 1 are provided with a common fuel supply passage, i.e. a common rail 51. The fuel in a fuel tank 52 is supplied to the common rail 51 through a fuel filter 54 by the operation of a fuel pump 53. The common rail 51 communicates with each fuel injector 1, and the fuel is returned to the fuel tank 52 through a fuel return passage 55. Each fuel injector has a fuel supply port 11 and a fuel discharge port 12 in the common rail 51 to which a fuel of a predetermined pressure is constantly supplied. The opening/closing of the injection port of each fuel injector 1 is done by controlling a solenoid 10.

The fuel injector 1 is formed so that a high-pressure working fluid (i.e. a working oil) is supplied to the pressure chamber 8 so as to increase the pressure of the fuel supplied to the fuel injector 1. Each fuel injector 1 is connected to a high-pressure oil manifold 56. The high-pressure oil manifold 56 is supplied with the oil from an oil reservoir 57 through an oil supply passage 61 by the operation of an oil pump 58, and the oil supply passage 61 is provided in its intermediate portion with an oil cooler 59 and an oil filter 60. The oil supply passage 61 branches into a lubrication passage 67 communicating with an oil gallery 62, and a working oil passage 66 from which the working oil is supplied to the pressure chambers in the fuel injectors. The working oil passage 66 is provided with a high-pressure oil pump 63, and the supply of the oil from the high-pressure oil pump 63 to the high-pressure oil manifold 56 is controlled by a flow rate control valve 64. A controller 50 is formed so as to control the flow rate control valve 64 and the solenoids 10 of the fuel injectors 1.

When the solenoid 10 in the fuel injector shown in FIG. 3 for internal combustion engines is energized by an instruction from the controller (FIG. 2), an armature 32 is attracted thereto, so that the solenoid valve 16 fixed to the armature 32 is lifted against the resilient force of the return spring 19. When the solenoid valve 16 is lifted, a port 33 is opened, and the high-pressure working oil is supplied from the high-pressure manifold 56 to the pressure chamber 8 through a supply passage 31 and a passage 34 which are formed in the injector body 4. When the high-pressure working oil is supplied to the pressure chamber 8, a working pressure is exerted on the upper surface of the large-diameter portion 25 of the pressure increasing piston 9. The fuel is supplied from the supply port 11 formed in the case 6 to the fuel chamber 20, and then from the fuel chamber 20 to the pressure increasing chamber 7 through an orifice 35.

When the pressure increasing piston 9 is moved down by the working oil, the orifice 35 is closed to cause the pressure of the fuel in the pressure increasing chamber 7 to increase. When the pressure of the fuel in the pressure increasing chamber 7 is thus increased, the fuel pressure causes the needle valve 23 to lift against the resilient force of the return spring 18. When the solenoid 10 is deenergized, the solenoid valve 16 lowers due to the resilient force of the return spring 19, and the high-pressure working oil in the pressure chamber 8 is drained through a drain groove 39 and a drain passage 38 which are provided in the solenoid valve 16. When the high-pressure working oil in the high-pressure chamber 8 is thus drained, the pressure increasing piston 9 returns to its original position owing to the resilient force of the return spring 17, and the pressure in the pressure increasing chamber 7 becomes equal to that in the fuel chamber 20 to cause the fuel pressure applied to the needle valve 23 to decrease, and cause the injection ports 13 to be closed by the needle valve 23 owing to the resilient force of the return spring 18.

In the injector for internal combustion engines, the hollow portion 30 in which the pressure increasing piston 9 is provided communicates with the fuel chamber 20 through the passage 28, and the fuel pressure in the hollow portion 30 is equal to that in the fuel chamber 20. Therefore, even though the pressure increasing piston 9 is pressed down by the pressure of the high-pressure working oil in the pressure chamber 8, it is necessary that the fuel in the hollow portion 30 be discharged by this oil pressure to the fuel chamber 20 through the passage 28, so that the valve timing responsiveness lowers. Namely, in order to lower the pressure increasing piston 9 by the working oil pressure to cause the pressure in the pressure increasing chamber 7 to increase, the needle valve 23 to be lifted and the fuel to be injected from the fuel injection ports 13, the fuel in the hollow portion 30 in which the return spring 17 is provided must be discharged to the fuel chamber 20 through the passage 28. During the discharge of the fuel to the fuel chamber 20 through the passage 28, a force stronger than that of the resistance of the passage 28 or that of the fuel pressure in the fuel chamber 20 is required, so that the behavior time of the vertical movement of the pressure increasing piston 9 is prolonged. Consequently, the injection duration increases, and the advantages of this high-pressure injection system are lost.

SUMMARY OF THE INVENTION

An object of the present invention is to solve these problems and provide a pressure increasing type fuel injector for internal combustion engines, wherein the pressure of a fuel accumulated in a common rail is increased in a pressure increasing chamber, and thereafter, the fuel is injected, characterized in that a hollow portion in which a return spring for returning a pressure increasing piston operated by a high-pressure working fluid in a pressure chamber is provided is opened to the atmospheric air, thereby the behavior, vertical movement, of the piston is sharply shortened, and the needle valve opening/closing timing responsiveness is consequently improved.

The present invention relates to a fuel injector for internal combustion engine in which a pressure increasing piston is moved by working fluid pressure to inject fuel comprising injection ports for fuel injection, a pressure increasing piston provided with a small and large diameter portions, a small diameter hollow with which said small diameter portion of said pressure increasing piston is fitted slidably, a large diameter hollow with which said large diameter portion of said pressure increasing piston is fitted slidably, a fuel pressure increasing chamber formed by an end of said small diameter portion of said pressure increasing piston and said small diameter hollow, and which is communicated with a fuel supply passage and injection ports, a pressure chamber formed by an end of said large diameter portion of said pressure increasing piston and said large diameter hollow, and which is communicated with a working fluid supply source, a return spring biasing said pressure increasing piston toward said pressure chamber and which is disposed in said large diameter hollow, a seal member provided around said small diameter portion of said pressure increasing piston, at least one port communicating a large diameter hollow portion with atmospheric air.

Further, the present invention relates to a fuel injector for internal combustion engines comprising an injector body provided with injection ports from which a fuel is injected, a case provided on the outside of the injector body so as to form a fuel chamber, a common rail communicating with the fuel chamber through fuel ports formed in the case, a pressure increasing chamber formed in the injector body and adapted to increase the fuel supplied from the fuel chamber, fuel passages formed in the injector body so as to supply the fuel from the pressure increasing chamber to the injection ports, a needle valve which is supported slidably in a first hollow formed in the injector body, and which is adapted to open the injection ports by a fuel pressure, a return spring for biasing the needle valve by the resilient force thereof in such a direction that the injection port is closed a pressure increasing piston adapted to increase the pressure of the fuel in the pressure increasing chamber, a pressure chamber to which a high-pressure working oil for exerting a high working pressure to an end portion of the pressure increasing piston is supplied, and a control valve for controlling the supply of the high-pressure working oil to the pressure chamber; the pressure increasing piston comprising a small-diameter portion defining a part of the pressure increasing chamber, a large-diameter portion defining a part of the pressure chamber and a guide ring portion extending downward from the whole circumference of the large-diameter portion and forming a sliding surface, a return spring for biasing the pressure increasing piston toward the pressure chamber being provided in a hollow portion formed of a second hollow, which is on the outside of the small-diameter portion, of the injector body, the injector body being provided with communication ports for opening the hollow portion to the atmospheric air.

In this fuel injector for internal combustion engines, in the hollow of the injector body in which the small-diameter portion of the pressure increasing piston slides is provided, a seal member for preventing the leakage of a fuel from the pressure increasing chamber to the hollow portion is provided.

In this fuel injector for internal combustion engines, in the hollow of the injector body in which the large-diameter portion and guide ring portion of the pressure increasing piston slide a seal member for preventing the leakage of a high-pressure working fluid from the pressure chamber to the hollow portion is provided.

In this fuel injector for internal combustion engines, a check valve is provided in a fuel passage which for communication of the pressure increasing chamber with fuel chamber.

The supply of a fuel to the fuel chamber is done through fuel supply passages extending between the cylinders.

The control valve comprises a solenoid valve adapted to control the supply of a high-pressure oil to the pressure chamber in accordance with the operational condition of the engine.

In this fuel injector, the hollow portion in which the return spring for returning the pressure increasing piston is provided is opened to the atmospheric air as mentioned above. Accordingly, when the pressure increasing piston is moved down, only the air in the hollow portion is discharged through the communication ports, and the resistance to the vertical movement of the pressure increasing piston is eliminated. This enables the pressure increasing piston to be moved up and down smoothly, the lowering behavior of the pressure increasing piston to be shortened, the responsiveness to the high-pressure working oil to be improved, the injection duration of the needle valve to be shortened, the after-dribble from the fuel injection ports to be prevented, production of smoke to be reduced, and the thermal efficiency to be improved.

When the high-pressure working oil is supplied to the pressure chamber in this fuel injector, the pressure increasing piston discharges the air from the hollow portion to the outside through the communication ports and moves down, and, during this time, the discharge of the air is done without any resistance. When the high-pressure working oil in the pressure chamber is discharged through a drain passage, the pressure increasing piston is moved up to its original position owing to the resilient force of the return spring, the air flows into the hollow portion through the communication ports. Therefore, the pressure in the hollow portion does not become negative, and a resistance to the upward movement of the pressure increasing piston does not occur.

The hollow portion of the injector body can be sealed reliably with a seal member provided on the outer circumference surface of the large-diameter portion of the pressure increasing piston, with respect to the pressure chamber, and with a seal member on the outer circumference surface of the small-diameter portion of the pressure increasing piston, with respect to the pressure increasing chamber.

DETAILED DESCRIPTION OF THE EMBODIMENT

Figure 1:
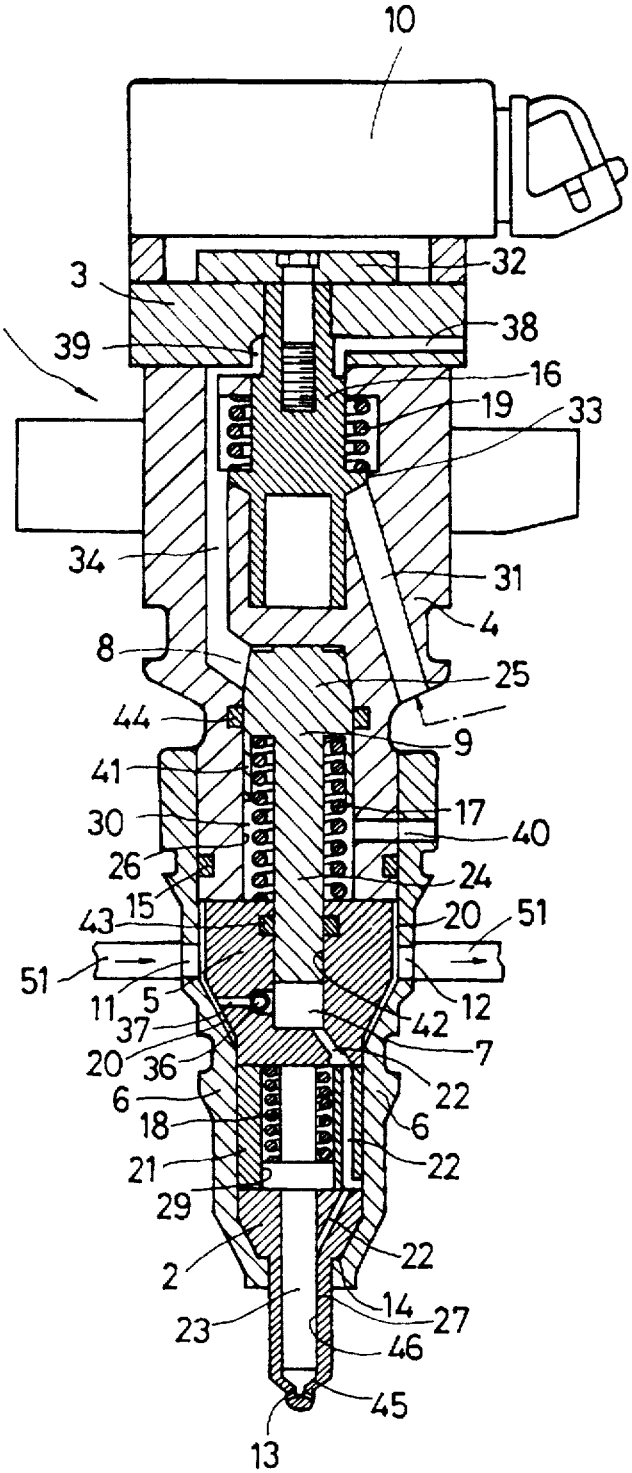
FIG. 1 is a sectional view showing an embodiment of the fuel injector for internal combustion engines according to the present invention.

An embodiment of the fuel injector for internal combustion engines according to the present invention will now be described with reference to FIGS. 1 and 2. In FIG. 1, the parts having the same functions as those shown in FIG. 3 are designated by the same reference numerals.

Figure 2:
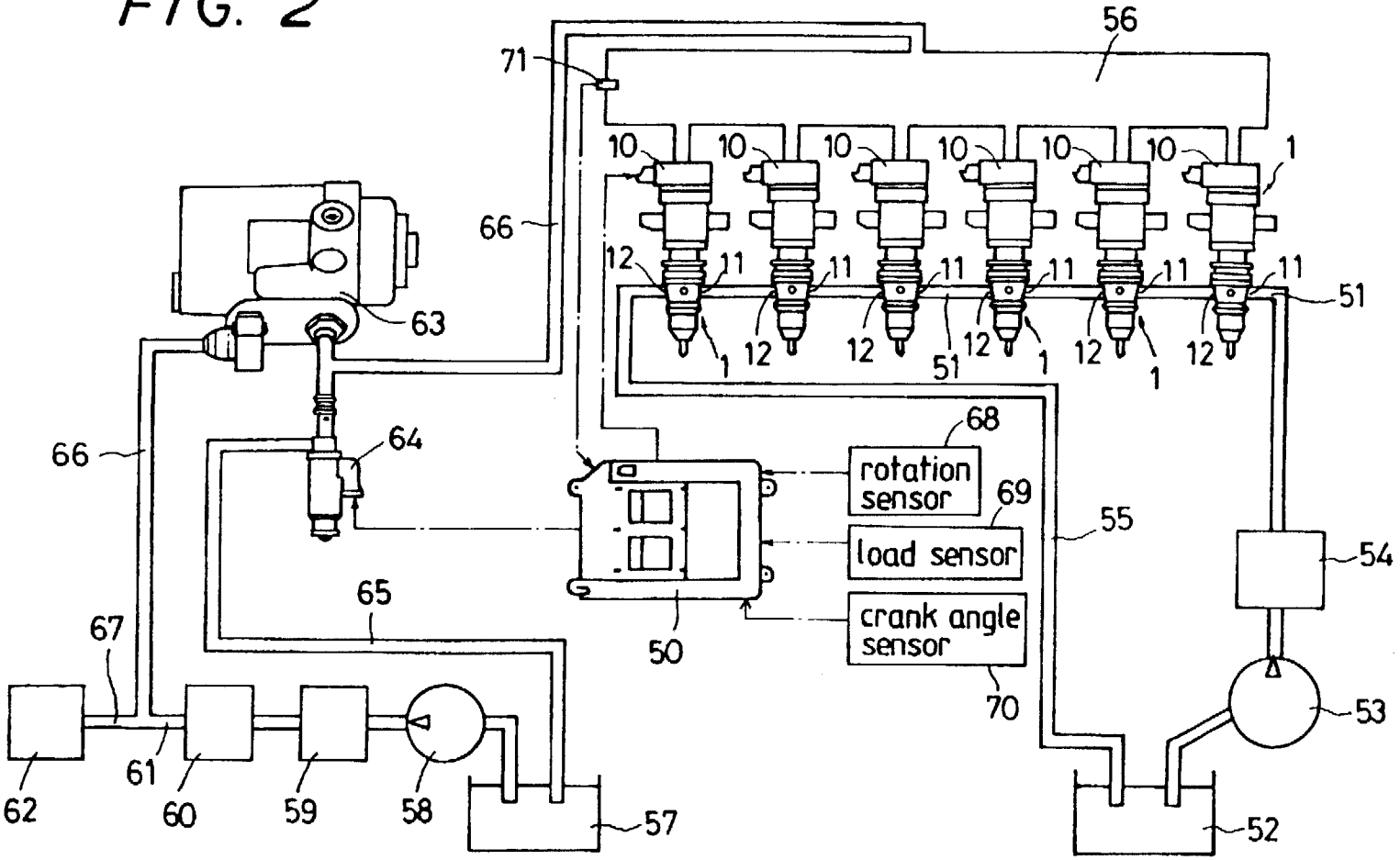
FIG. 2 is a schematic explanatory view showing a fuel supply system for the fuel injector for internal combustion engines.
Figure 3:
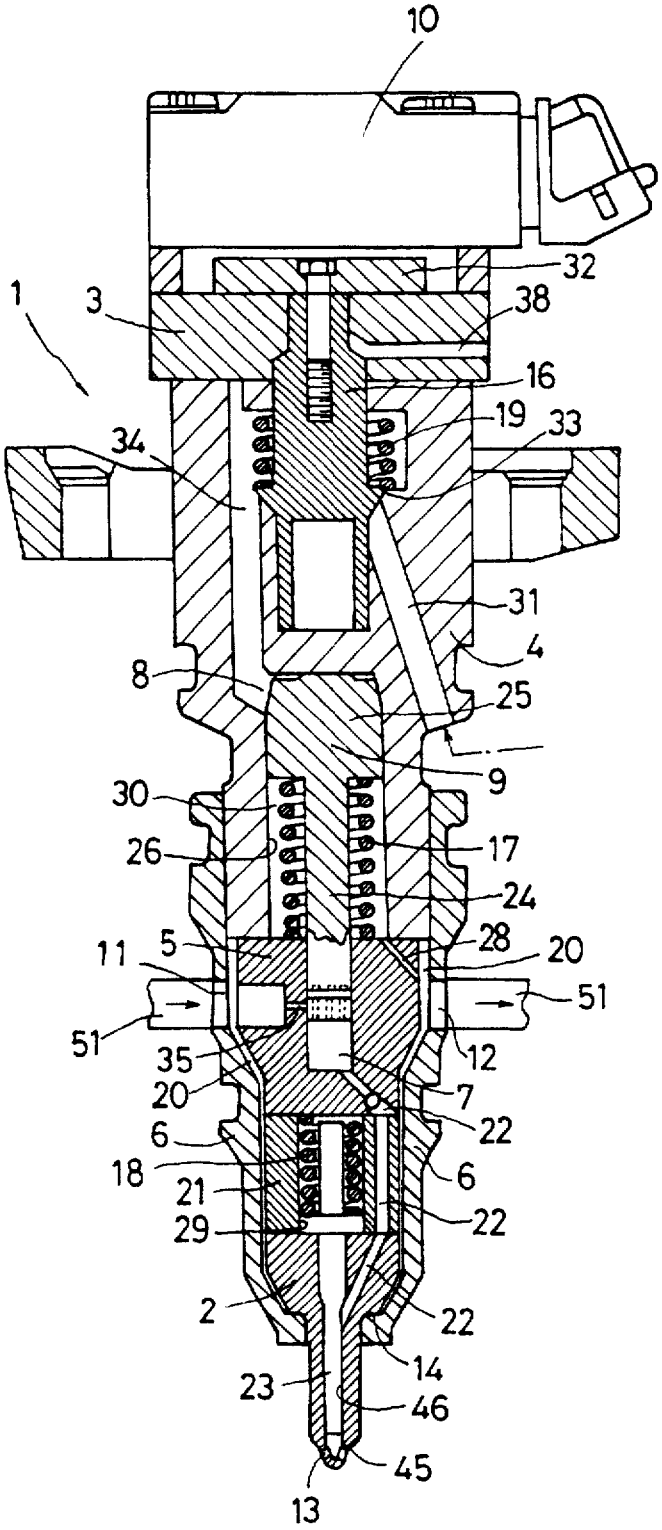
FIG. 3 (PRIOR ART)
FIG. 3 is a sectional view showing a conventional fuel injector for internal combustion engines.

The fuel injector shown in FIG. 1 is used by incorporating it into the fuel supply system of FIG. 2 therein, each cylinder of an engine being provided with this fuel supply system. In this embodiment, one fuel injector will be described with reference to FIG. 1. The fuel injector 1 has a fuel supply port 11 and a fuel discharge port 12 which are opened in a common rail 51 in the fuel supply system, and a fuel of a predetermined pressure is supplied constantly to the fuel injector. The fuel injector 1 comprises a nozzle body 2 constituting an injector body and provided with a hollow therein, a spacer body 21 provided with a hollow 29, a fuel supply body 5 provided with a pressure increasing chamber 7 for increasing the pressure of the fuel, an injector body 4 provided with a pressure chamber 8 to which a high-pressure working oil is supplied, and a solenoid body 3 adapted to operate a solenoid valve 16 provided with a drain passage 38 constituting a leak passage.

A case 6 is fitted around the outer surfaces of the nozzle body 2 constituting the injector body, the spacer body 21, the fuel supply body 5 and the injector body 4 with a clearance formed therebetween, and a fuel chamber 20 is also formed. One end portion of the fuel chamber 20 is sealed with a contact surface 14 at which an end surface of the case 6 is engaged with a stepped portion of the nozzle body 2, and the other end portion thereof with a seal member 15 fitted in an annular groove in the injector body 4. A pressure increasing piston 9 is inserted in a hollow 42 formed in the fuel supply body 5, and a pressure increasing chamber 7 adapted to increase the pressure of the fuel supplied from the fuel chamber 20 through a fuel passage 37 is formed in an end portion of the hollow 42. The fuel passage 37 is provided with check valves 36 for preventing the high-pressure fuel in the pressure increasing chamber 7 from flowing back to the fuel chamber 20. The fuel in the pressure increasing chamber 7 is supplied to injection ports 13 through a fuel passage 22 formed in the fuel supply body 5, a fuel passage 22 formed in the spacer body 21 and a fuel passage 22 formed in the nozzle body 2. A needle valve 23 is held slidably in a hollow 46 of the nozzle body 2 and adapted to open the injection ports 13. A fuel passage 27 is formed between the nozzle body 2 and needle valve 23, and the needle valve 23 is lifted when a high fuel pressure is exerted on a tapered surface 45 of an end portion thereof.

A hollow 29 of the spacer body 21 is provided therein with a return spring 18 adapted to bias the needle valve by the resilient force thereof in such a direction that the injection ports 13 are closed. One end of the return spring 18 is in contact with the upper end of the needle valve 23, and the other end thereof in contact with the fuel supply body 5. The pressure chamber 8 formed in the injector body 4 is supplied with a high-pressure working oil from a high-pressure oil manifold 56, and adapted to exert the pressure of the high-pressure working oil on the upper surface of the pressure increasing piston 9 and lower the piston 9, whereby the pressure of the fuel in the pressure increasing chamber 7 is increased. In order to supply the high-pressure working oil to the pressure chamber 8, the solenoid valve 16 is lifted by the energized solenoid 10 to open a port 33 of an oil supply passage 31 formed in the injector body 4. When the port 33 openes, the high-pressure working oil from the high-pressure oil manifold 56 is supplied to the pressure chamber 8 through the port 33 and an oil passage 34.

This fuel injector of the above-described construction for internal combustion engines is provided with a hollow portion 30 comprising a hollow 26 of the injector body 4 in which a return spring 17 for biasing the pressure increasing piston 9 toward the pressure chamber 8 is provided, and, especially, a communication port 40 for opening the hollow portion 30 which extend over the injector body 4 and the case 6 to the atmospheric air. The pressure increasing piston 9 comprises a small-diameter portion 24 defining a part of the pressure increasing chamber 7, a large-diameter portion defining a part of the pressure chamber 8, and a guide ring portion 41 extending downward from the whole circumference of the large-diameter portion and forming a sliding surface with respect to the hollow 26 of the injector body 4. The guide ring portion 41 has a function of stabilizing the vertical movement of the pressure increasing piston 9. In order to prevent the high-pressure fuel in the pressure increasing chamber 7 from leaking to the hollow portion 30, a seal member 43, such as an O-ring is provided in an annular groove formed in a wall surface of the hollow 42, in which the small-diameter portion 24 of the pressure increasing piston 9 slides, of the fuel supply body 5. A seal member 44 is provided in an annular groove formed in a wall surface of the hollow 26, in which the large-diameter portion 25 and guide ring portion 41 of the pressure increasing piston 9 slide, of the injector body 4, so as to prevent the high-pressure working oil in the pressure chamber 8 from leaking to the hollow portion 30.

This fuel injector for internal combustion engines is constructed as described above and operated as follows. In this fuel injector for internal combustion engines, the solenoid valve constituting a control valve is operated by a controller 50 in accordance with the operational condition of an engine. As shown in FIG. 2, the rotational speed of the engine detected by a rotation sensor 68, the degree of opening of an accelerator detected by a load sensor 69 and the crank angle detected by an accelerator opening and position sensor 70 are inputted as information on the operational condition of the engine into the controller 50. The working oil pressure in the high-pressure oil manifold 56 which is detected by a pressure sensor 71 provided therein is also inputted into the controller 50. The controller 50 is adapted to control the timing of the operation of the solenoid 10, and the flow rate control valve 64, which is operated for maintaining the working oil pressure in the high-pressure oil manifold 56 at a suitable level, in accordance with these detected values. When the solenoid is energized in accordance with an instruction from the controller 50, an armature 32 is attracted thereto and the solenoid valve 16 is lifted. When the solenoid valve 16 is lifted, the port 33 is opened, and the high-pressure working oil is supplied from the high-pressure oil manifold 56 to the pressure chamber 8 through the oil supply passage 31 and passage 34.

When the high-pressure working oil is supplied to the pressure chamber 8, the working oil pressure is exerted on the pressure increasing piston 9, causing the piston 9 to lower. During this time, the pressure increasing piston 9 is moved down smoothly without any resistance to this movement since the hollow portion 3O on the back side of the pressure increasing piston 9 is opened to the atmospheric air through the communication port 40. When the pressure increasing piston 9 is moved down, the end surface of the small-diameter portion 24 thereof pressurizes the fuel in the pressure increasing chamber 7, increasing the pressure thereof to a high level. During this time, a check valve 36 provided in the fuel passage 37 prevents the high-pressure fuel in the pressure increasing chamber 7 from flowing reversely to the fuel chamber 20. The high-pressure fuel in the pressure increasing chamber 7 acts on the tapered surface 45 of the tip portion of the needle valve 23 through the fuel passages 22, and the needle valve 23 is thereby lifted against the resilient force of the return spring 18, whereby the high-pressure fuel is injected from the injection ports 13.

When the solenoid 10 is deenergized according to an instruction from the controller 50, the solenoid valve 16 closes the port 33 owing to the resilient force of the return spring 19, and the annular groove, i.e. the drain groove 39 formed in the outer circumferential surface of the solenoid valve 6 is made to communicate with the pressure chamber 8. Consequently, the high-pressure working oil in the pressure chamber is discharged through the drain passage 38, so that the pressure chamber 8 is opened to the atmospheric air. When the high-pressure working oil is discharged from the pressure chamber 8, the pressure-increasing piston 9 is returned to its original position owing to the resilient force of the return spring 17. During this time, the air smoothly flows into the hollow portion 30 through the communication port 40 since the hollow portion 30 which is on the back side of the pressure increasing piston 9 is opened to the atmospheric air. Namely, since the pressure of the hollow portion 30 which is on the back side of the pressure increasing piston 9 does not become negative, a force for preventing the upward movement of the pressure increasing piston 9 is not exerted thereon at all. When the pressure increasing piston 9 is lifted, the pressure of the fuel in the pressure increasing chamber 7 becomes equal to that of the fuel in the fuel chamber 20, and the fuel pressure exerted on the needle valve 23 also decreases. Accordingly, the needle valve 23 is lowered by the resilient force of the return spring 18 to close the injection ports 13, finishing one stroke of a fuel injection period.

What is claimed is:

1. A fuel injector for internal combustion engine in which a pressure increasing piston is moved by working fluid pressure to inject fuel comprising injection ports for fuel injection, a pressure increasing piston provided with a small and large diameter portions, a small diameter hollow with which said small diameter portion of said pressure increasing piston is fitted slidably, a large diameter hollow with which said large diameter portion of said pressure increasing piston is fitted slidably, a fuel pressure increasing chamber formed by an end of said small diameter portion of said pressure increasing piston and said small diameter hollow, and which is communicated with a fuel supply passage and injection ports, a pressure chamber formed by an end of said large diameter portion of said pressure increasing piston and said large diameter hollow, and which is communicated with a working fluid supply source, a return spring biasing said pressure increasing piston toward said pressure chamber and which is disposed in said large diameter hollow, a seal member provided around said small diameter portion of said pressure increasing piston, at least one port communicating a large diameter hollow portion with atmospheric air.

2. A fuel injector for internal combustion engines comprising an injector body provided with injection ports from which a fuel is injected, a case provided on the outside of said injector body so as to form a fuel chamber, a common rail communicating with said fuel chamber through fuel ports formed in said case, a pressure increasing chamber formed in said injector body and adapted to increase the fuel supplied from said fuel chamber, fuel passages formed in said injector body so as to supply the fuel from said pressure increasing chamber to said injection ports, a needle valve which is supported slidably in a first hollow formed in said injector body, and which is adapted to open said injection ports by a fuel pressure, a return spring biasing said needle valve by the resilient force thereof in such a direction that the injection ports is closed, a pressure increasing piston adapted to increase the pressure of the fuel in said pressure increasing chamber, a pressure chamber to which a high-pressure working oil for exerting a high working pressure to an end portion of said pressure increasing piston is supplied, and a control valve for controlling the supply of the high-pressure working oil to said pressure chamber; the pressure increasing piston comprising a small-diameter portion defining a part of said pressure increasing chamber, a large-diameter portion defining a part of said pressure chamber and a guide ring portion extending downward from the whole circumference of said large-diameter portion and forming a sliding surface, a return spring for biasing said pressure increasing piston toward said pressure chamber being provided in a hollow portion formed of a second hollow, on the outside of said small-diameter portion, of said injector body, said injector body being provided with communication ports for opening said hollow portion to the atmospheric air.

3. A fuel injector for internal combustion engines according to claim 2, wherein in a third hollow of said injector body in which said small-diameter portion of said pressure increasing piston slides, a seal member for preventing the leakage of a fuel from said pressure increasing chamber to said hollow portion is provided.

4. A fuel injector for internal combustion engines according to claim 2, wherein in said second hollow of said injector body in which said large-diameter portion and said guide ring portion of said pressure increasing piston slide, a seal member for preventing the leakage of a high-pressure working fluid from said pressure chamber to said hollow portion is provided.

5. A fuel injector for internal combustion engines according to claim 2, wherein a fuel passage for communication of said pressure increasing chamber with said fuel chamber is provided with a check valve for preventing the high-pressure fuel in said pressure increasing chamber from flowing reversely to said fuel chamber.

6. A fuel injector for internal combustion engines according to claim 2, wherein the supply of a fuel to said fuel chamber is done through a fuel supply passage extending between cylinders.

7. A fuel injector for internal combustion engines according to claim 2, wherein said control valve comprises a solenoid valve adapted to control the supply of a high-pressure oil to said pressure chamber in accordance with the operational condition of an engine.

* * * * *